US008863460B2

(12) United States Patent
Hohmann, Jr.

(10) Patent No.: US 8,863,460 B2
(45) Date of Patent: Oct. 21, 2014

(54) THERMALLY COATED WALL ANCHOR AND ANCHORING SYSTEMS WITH IN-CAVITY THERMAL BREAKS

(71) Applicant: Mitek Holdings, Inc., Wilmington, DE (US)

(72) Inventor: Ronald P. Hohmann, Jr., Hauppauge, NY (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 13/789,995

(22) Filed: Mar. 8, 2013

(65) Prior Publication Data

US 2014/0250809 A1 Sep. 11, 2014

(51) Int. Cl.
*E04B 1/16* (2006.01)
*E04B 1/41* (2006.01)

(52) U.S. Cl.
CPC ..... *E04B 1/4178* (2013.01)
USPC ..... 52/513; 52/699; 52/426; 52/428; 52/379; 52/713; 52/383

(58) Field of Classification Search
CPC ..... E04B 1/4178; E04B 1/2608; E04B 1/41; E04B 2/30
USPC ..... 52/378, 379, 383, 508, 513, 713, 714, 52/712, 506.1, 562, 565, 649.1, 443, 444, 52/415, 506.05, 506.06
See application file for complete search history.

(56) References Cited

U.S. PATENT DOCUMENTS 819,869 A 5/1906 Dunlap
903,000 A 11/1908 Priest, Jr.
1,170,419 A 2/1916 Coon
1,794,684 A 3/1931 Handel
2,058,148 A 10/1936 Hard
2,097,821 A 11/1937 Mathers
2,280,647 A 4/1942 Hawes
2,300,181 A 10/1942 Spaight (Continued)

FOREIGN PATENT DOCUMENTS

CH 279209 3/1952
EP 0199595 B1 3/1995

(Continued)

OTHER PUBLICATIONS

ASTM Standard E754-80 (2006), Standard Test Method for Pullout Resistance of Ties and Anchors Embedded in Masonry Mortar Joints, ASTM International, 8 pages, West Conshohocken, Pennsylvania, United States.

(Continued)

*Primary Examiner* — Mark Wendell
(74) *Attorney, Agent, or Firm* — Silber & Fridman

(57) ABSTRACT

Thermally-isolating wall anchors and anchoring systems employing the same are disclosed. A thermally-isolating coating is applied to the wall anchor, which is interconnected with a wire formative veneer tie. The thermally-isolating coating is selected from a distinct grouping of materials, that are applied using a specific variety of methods, in one or more layers and cured and cross-linked to provide high-strength adhesion. The thermally-coated wall anchors provide an in-cavity thermal break that severs the thermal threads running throughout the cavity wall structure, reducing the U- and K-values of the anchoring system by thermally-isolating the metal components.

12 Claims, 5 Drawing Sheets

(56) References Cited

U.S. PATENT DOCUMENTS 2,403,566 A 7/1946 Thorp et al.
2,413,772 A 1/1947 Morehouse
2,605,867 A 8/1952 Goodwin
2,780,936 A 2/1957 Hillberg
2,929,238 A 3/1960 Kaye
2,966,705 A 1/1961 Massey
2,999,571 A 9/1961 Huber
3,030,670 A 4/1962 Bigelow
3,183,628 A 5/1965 Smith
3,254,736 A 6/1966 Gass
3,277,626 A 10/1966 Brynjolfsson et al.
3,300,939 A 1/1967 Brynjolfsson et al.
3,309,828 A 3/1967 Tribble
3,310,926 A 3/1967 Brandreth et al.
3,341,998 A 9/1967 Lucas
3,377,764 A 4/1968 Storch
3,478,480 A 11/1969 Swenson
3,563,131 A 2/1971 Ridley, Sr.
3,568,389 A 3/1971 Gulow
3,640,043 A 2/1972 Querfeld et al.
3,964,226 A 6/1976 Hala et al.
3,964,227 A 6/1976 Hala
4,021,990 A 5/1977 Schwalberg
4,227,359 A 10/1980 Schlenker
4,238,987 A 12/1980 Siebrecht-Reuter
4,305,239 A 12/1981 Geraghty
4,373,314 A 2/1983 Allan
4,382,416 A 5/1983 Kellogg-Smith
4,424,745 A 1/1984 Magorian et al.
4,438,611 A 3/1984 Bryant
4,473,984 A 10/1984 Lopez
4,482,368 A 11/1984 Roberts
4,571,909 A 2/1986 Berghuis et al.
4,596,102 A 6/1986 Catani et al.
4,598,518 A 7/1986 Hohmann
4,606,163 A 8/1986 Catani
4,628,657 A 12/1986 Ermer et al.
4,636,125 A 1/1987 Burgard
4,640,848 A 2/1987 Cerdan-Diaz et al.
4,660,342 A 4/1987 Salisbury
4,703,604 A 11/1987 Muller
4,708,551 A 11/1987 Richter et al.
4,738,070 A 4/1988 Abbott et al.
4,764,069 A 8/1988 Reinwall et al.
4,819,401 A 4/1989 Whitney, Jr.
4,827,684 A 5/1989 Allan
4,843,776 A 7/1989 Guignard
4,852,320 A 8/1989 Ballantyne
4,869,038 A 9/1989 Catani
4,869,043 A 9/1989 Hatzinikolas et al.
4,875,319 A 10/1989 Hohmann
4,911,949 A 3/1990 Iwase et al.
4,922,680 A 5/1990 Kramer et al.
4,946,632 A 8/1990 Pollina
4,955,172 A 9/1990 Pierson
5,063,722 A 11/1991 Hohmann
5,099,628 A 3/1992 Noland et al.
5,207,043 A 5/1993 McGee et al.
5,307,602 A 5/1994 Lebraut
5,392,581 A 2/1995 Hatzinikolas et al.
5,408,798 A 4/1995 Hohmann
5,440,854 A 8/1995 Hohmann
5,454,200 A 10/1995 Hohmann
5,456,052 A 10/1995 Anderson et al.
5,490,366 A 2/1996 Burns et al.
5,598,673 A 2/1997 Atkins
5,634,310 A 6/1997 Hohmann
5,669,592 A 9/1997 Kearful
5,671,578 A 9/1997 Hohmann
5,673,527 A 10/1997 Coston et al.
5,755,070 A 5/1998 Hohmann
5,816,008 A 10/1998 Hohmann
5,819,486 A 10/1998 Goodings
5,845,455 A 12/1998 Johnson, III
6,000,178 A 12/1999 Goodings
6,125,608 A 10/2000 Charlson
6,209,281 B1 4/2001 Rice
6,279,283 B1 8/2001 Hohmann et al.
6,284,311 B1 9/2001 Gregorovich et al.
6,332,300 B1 12/2001 Wakai
6,351,922 B1 3/2002 Burns et al.
6,367,219 B1 4/2002 Quinlan
6,612,343 B2 9/2003 Camberlin et al.
6,627,128 B1 9/2003 Boyer
6,668,505 B1 12/2003 Hohmann et al.
6,686,301 B2 2/2004 Li et al.
6,735,915 B1 5/2004 Johnson, III
6,739,105 B2 5/2004 Fleming
6,789,365 B1 9/2004 Hohmann et al.
6,817,147 B1 11/2004 MacDonald
6,827,969 B1 12/2004 Skoog et al.
6,837,013 B2 1/2005 Foderberg et al.
6,851,239 B1 2/2005 Hohmann et al.
6,925,768 B2 8/2005 Hohmann et al.
6,941,717 B2 9/2005 Hohmann et al.
6,968,659 B2 11/2005 Boyer
7,007,433 B2 3/2006 Boyer
7,017,318 B1 3/2006 Hohmann et al.
7,043,884 B2 5/2006 Moreno
7,059,577 B1 6/2006 Burgett
D527,834 S 9/2006 Thimons et al.
7,147,419 B2 12/2006 Balbo Di Vinadio
7,152,382 B2 12/2006 Johnson, III
7,171,788 B2 2/2007 Bronner
7,178,299 B2 2/2007 Hyde et al.
D538,948 S 3/2007 Thimons et al.
7,225,590 B1 6/2007 diGirolamo et al.
7,325,366 B1 2/2008 Hohmann, Jr. et al.
7,334,374 B2 2/2008 Schmid
7,374,825 B2 5/2008 Hazel et al.
7,415,803 B2 8/2008 Bronner
7,481,032 B2 1/2009 Tarr
7,552,566 B2 6/2009 Hyde et al.
7,562,506 B2 7/2009 Hohmann, Jr.
7,587,874 B2 9/2009 Hohmann, Jr.
7,735,292 B2 6/2010 Massie
7,748,181 B1 7/2010 Guinn
7,788,869 B2 9/2010 Voegele, Jr.
D626,817 S 11/2010 Donowho et al.
7,845,137 B2 12/2010 Hohmann, Jr.
8,037,653 B2 10/2011 Hohmann, Jr.
8,051,619 B2 11/2011 Hohmann, Jr.
8,096,090 B1 1/2012 Hohmann, Jr. et al.
8,109,706 B2 2/2012 Richards
8,122,663 B1 2/2012 Hohmann, Jr. et al.
8,201,374 B2 * 6/2012 Hohmann, Jr. ..... 52/379
8,209,934 B2 7/2012 Pettingale
8,215,083 B2 7/2012 Toas et al.
8,291,672 B2 10/2012 Hohmann, Jr. et al.
8,347,581 B2 1/2013 Doerr et al.
8,375,667 B2 2/2013 Hohmann, Jr.
8,418,422 B2 4/2013 Johnson, III
8,511,041 B2 8/2013 Fransen
8,516,763 B2 8/2013 Hohmann, Jr.
8,516,768 B2 8/2013 Johnson, III
8,544,228 B2 10/2013 Bronner
8,555,587 B2 10/2013 Hohmann, Jr.
8,555,596 B2 10/2013 Hohmann, Jr.
8,596,010 B2 12/2013 Hohmann, Jr.
8,613,175 B2 12/2013 Hohmann, Jr.
8,667,757 B1 3/2014 Hohmann, Jr.
2001/0054270 A1 12/2001 Rice
2002/0100239 A1 8/2002 Lopez
2003/0121226 A1 7/2003 Bolduc
2004/0083667 A1 5/2004 Johnson, III
2004/0231270 A1 11/2004 Collins et al.
2005/0279043 A1 12/2005 Bronner
2006/0198717 A1 9/2006 Fuest
2006/0242921 A1 11/2006 Massie
2006/0251916 A1 11/2006 Arikawa et al.
2008/0092472 A1 4/2008 Doerr et al.
2008/0141605 A1 6/2008 Hohmann
2008/0222992 A1 9/2008 Hikai et al.
2009/0133351 A1 5/2009 Wobber

(56) References Cited

U.S. PATENT DOCUMENTS

| | | | | |
|---|---|---|---|---|
| 2009/0133357 | A1 | 5/2009 | Richards | |
| 2010/0037552 | A1 | 2/2010 | Bronner | |
| 2010/0101175 | A1 | 4/2010 | Hohmann | |
| 2010/0192495 | A1 | 8/2010 | Huff et al. | |
| 2010/0257803 | A1 | 10/2010 | Hohmann, Jr. | |
| 2011/0023748 | A1 | 2/2011 | Wagh et al. | |
| 2011/0041442 | A1 | 2/2011 | Bui | |
| 2011/0047919 | A1 | 3/2011 | Hohmann, Jr. | |
| 2011/0061333 | A1 | 3/2011 | Bronner | |
| 2011/0083389 | A1 | 4/2011 | Bui | |
| 2011/0146195 | A1 | 6/2011 | Hohmann, Jr. | |
| 2011/0173902 | A1 | 7/2011 | Hohmann, Jr. et al. | |
| 2011/0277397 | A1 | 11/2011 | Hohmann, Jr. | |
| 2012/0186183 | A1 | 7/2012 | Johnson, III | |
| 2013/0008121 | A1* | 1/2013 | Dalen | 52/704 |
| 2013/0074435 | A1 | 3/2013 | Hohmann, Jr. | |
| 2013/0232909 | A1 | 9/2013 | Curtis et al. | |
| 2013/0232983 | A1 | 9/2013 | Hohmann, Jr. | |
| 2013/0247482 | A1 | 9/2013 | Hohmann, Jr. | |
| 2013/0247483 | A1 | 9/2013 | Hohmann, Jr. | |
| 2013/0247484 | A1 | 9/2013 | Hohmann, Jr. | |
| 2013/0247498 | A1 | 9/2013 | Hohmann, Jr. | |
| 2013/0340378 | A1 | 12/2013 | Hohmann, Jr. | |
| 2014/0000211 | A1 | 1/2014 | Hohmann, Jr. | |

FOREIGN PATENT DOCUMENTS

| | | | |
|---|---|---|---|
| GB | 1575501 | | 9/1980 |
| GB | 2069024 | A | 8/1981 |
| GB | 2246149 | A | 1/1992 |
| GB | 2265164 | A | 9/1993 |
| GB | 2459936 | A | 3/2013 |

OTHER PUBLICATIONS

Building Envelope Requirements for Commercial and High Rise Residential Buildings, 780 CMR sec. 1304.0 et seq. of Chapter 13, Jan. 1, 2001, 19 pages, Boston, Massachusetts, United States.

Building Code Requirements for Masonry Structures, ACI 530-05/ASCE 5-05/TMS 402-05, Chapter 6, 4 pages.

Hohmann & Barnard, Inc.; Product Catalog, 2009, 52 pages, Hauppauge, New York, United States.

"Effect of Insulation and Mass Distribution in Exterior Walls on Dynamic Thermal Performance of Whole Buildings", Jan Kosny, Ph.D, Elisabeth Kossecka, Ph.D., Thermal Envelopes VII/Building Systems—Principles p. 721-731.

ASTM Standard Specification A951/A951M—11, Table 1, Standard Specification for Steel Wire for Masonry Joint Reinforcement, Nov. 14, 2011, 6 pages, West Conshohocken, Pennsylvania, United States.

State Board of Building Regulations and Standards, Building Envelope Requirements, 780 CMR sec. 1304.0 et seq., 7th Edition, Aug. 22, 2008, 11 pages, Boston, MA, United States.

Hohmann & Barnard, Inc.; Product Catalog, 2003, 44 pages, Hauppauge, New York, United States.

* cited by examiner

THERMALLY COATED WALL ANCHOR AND ANCHORING SYSTEMS WITH IN-CAVITY THERMAL BREAKS

BACKGROUND OF THE INVENTION

1. Field of the Invention

This invention relates to thermally-coated wall anchors and associated veneer ties and anchoring systems for cavity walls. More particularly, the invention relates to anchoring systems with thermally-isolating coated wall anchors and associated components made largely of thermally conductive metals. The system has application to seismic-resistant structures and to cavity walls requiring thermal isolation.

2. Description of the Prior Art

The move toward more energy-efficient insulated cavity wall structures has led to the need to create a thermally isolated building envelope which separates the interior environment and the exterior environment of a cavity wall structure. The building envelope is designed to control temperature, thermal transfer between the wythes and moisture development, while maintaining structural integrity. Thermal insulation is used within the building envelope to maintain temperature and therefore restrict the formation of condensation within the cavity. The integrity of the thermal insulation is compromised when used in conjunction with the prior art metal anchoring systems, which are constructed from thermally conductive metals that facilitate thermal transfer between and through the wythes. The use of the specially designed and thermally-protected wall anchors of the present invention lowers the underlying metal thermal conductivities and thereby reducing thermal transfer.

When a cavity wall is constructed and a thermal envelope created, hundreds, if not thousands, of wall anchors and associated ties are inserted throughout the cavity wall. Each anchor and tie combination form a thermal bridge perforating the insulation and moisture barriers within the cavity wall structure. While seals at the insertion locations deter water and vapor entry, thermal transfer and loss still result. Further, when each individual anchoring system is interconnected veneer-tie-to-wall-anchor, a thermal thread results stretching across the cavity and extending between the inner wythe to the outer wythe. Failure to isolate the steel components and break the thermal transfer, results in heating and cooling losses and potentially damaging condensation buildup within the cavity wall structure. Such buildups provide a medium for corrosion and mold growth. The use of thermally-isolating coated wall anchors removes the thermal bridges and breaks the thermal thread causing a thermally isolated anchoring system with a resulting lower heat loss within the building envelope.

The present invention provides a thermally-isolating coated wall anchor specially-suited for use within a cavity wall. Anchoring systems within cavity walls are subject to varied outside forces such as earthquakes and wind shear that cause abrupt movement within the cavity wall, requiring high-strength anchoring materials. Additionally, any materials placed within the cavity wall require the characteristics of low flammability and, upon combustion, the release of combustion products with low toxicity. The present invention provides a coating suited to such requirements, which, besides meeting the flammability/toxicity standards, includes characteristics such as shock resistance, non-frangibility, low thermal conductivity and transmissivity, and a non-porous resilient finish. This unique combination of characteristics provides a wall anchor well-suited for installation within a cavity wall anchoring system.

In the past, anchoring systems have taken a variety of configurations. Where the applications included masonry backup walls, wall anchors were commonly incorporated into ladder- or truss-type reinforcements and provided wire-to-wire connections with box-ties or pintle-receiving designs on the veneer side.

In the late 1980's, surface-mounted wall anchors were developed by Hohmann & Barnard, Inc., now a MiTek-Berkshire Hathaway Company, and patented under U.S. Pat. No. 4,598,518. The invention was commercialized under trademarks DW-10®, DW-10-X®, and DW-10-HS®. These widely accepted building specialty products were designed primarily for dry-wall construction, but were also used with masonry backup walls. For seismic applications, it was common practice to use these wall anchors as part of the DW-10® Seismiclip® interlock system which added a Byna-Tie® wire formative, a Seismiclip® snap-in device—described in U.S. Pat. No. 4,875,319 (319), and a continuous wire reinforcement.

In an insulated dry wall application, the surface-mounted wall anchor of the above-described system has pronged legs that pierce the insulation and the wallboard and rest against the metal stud to provide mechanical stability in a four-point landing arrangement. The vertical slot of the wall anchor enables the mason to have the wire tie adjustably positioned along a pathway of up to 3.625-inch (max.). The interlock system served well and received high scores in testing and engineering evaluations which examined effects of various forces, particularly lateral forces, upon brick veneer masonry construction. However, under certain conditions, the system did not sufficiently maintain the integrity of the insulation. Also, upon the promulgation of more rigorous specifications by which tension and compression characteristics were raised, a different structure—such as one of those described in detail below—became necessary.

The engineering evaluations further described the advantages of having a continuous wire embedded in the mortar joint of anchored veneer wythes. The seismic aspects of these investigations were reported in the inventor's '319 patent. Besides earthquake protection, the failure of several high-rise buildings to withstand wind and other lateral forces resulted in the incorporation of a continuous wire reinforcement requirement in the Uniform Building Code provisions. The use of a continuous wire in masonry veneer walls has also been found to provide protection against problems arising from thermal expansion and contraction and to improve the uniformity of the distribution of lateral forces in the structure.

Shortly after the introduction of the pronged wall anchor, a seismic veneer anchor, which incorporated an L-shaped backplate, was introduced. This was formed from either 12- or 14-gauge sheetmetal and provided horizontally disposed openings in the arms thereof for pintle legs of the veneer anchor. In general, the pintle-receiving sheetmetal version of the Seismiclip interlock system served well, but in addition to the insulation integrity problem, installations were hampered by mortar buildup interfering with pintle leg insertion.

In the 1980's, an anchor for masonry veneer walls was developed and described in U.S. Pat. No. 4,764,069 by Reinwall et al. which patent is an improvement of the masonry veneer anchor of Lopez, U.S. Pat. No. 4,473,984. Here the anchors are keyed to elements that are installed using power-rotated drivers to deposit a mounting stud in a cementitious or masonry backup wall. Fittings are then attached to the stud which include an elongated eye and a wire tie therethrough for deposition in a bed joint of the outer wythe. It is instructive to note that pin-point loading—that is forces concentrated at substantially a single point—developed from this design configuration. This resulted, upon experiencing lateral forces over time, in the loosening of the stud.

There have been significant shifts in public sector building specifications, such as the Energy Code Requirement, Boston, Mass. (see Chapter 13 of 780 CMR, Seventh Edition). This Code sets forth insulation R-values well in excess of prior editions and evokes an engineering response opting for thicker insulation and correspondingly larger cavities. Here, the emphasis is upon creating a building envelope that is designed and constructed with a continuous air barrier to control air leakage into or out of conditioned space adjacent the inner wythe, which have resulted in architects and architectural engineers requiring larger and larger cavities in the exterior cavity walls of public buildings. These requirements are imposed without corresponding decreases in wind shear and seismic resistance levels or increases in mortar bed joint height. Thus, wall anchors are needed to occupy the same ⅜ inch high space in the inner wythe and tie down a veneer facing material of an outer wythe at a span of two or more times that which had previously been experienced.

As insulation became thicker, the tearing of insulation during installation of the pronged DW-10X® wall anchor, see infra, became more prevalent. This occurred as the installer would fully insert one side of the wall anchor before seating the other side. The tearing would occur at two times, namely, during the arcuate path of the insertion of the second leg and separately upon installation of the attaching hardware. The gapping caused in the insulation permitted air and moisture to infiltrate through the insulation along the pathway formed by the tear. While the gapping was largely resolved by placing a self-sealing, dual-barrier polymeric membrane at the site of the legs and the mounting hardware, with increasing thickness in insulation, this patchwork became less desirable. The improvements hereinbelow in surface mounted wall anchors look toward greater insulation integrity and less reliance on a patch.

As concerns for thermal transfer and resulting heat loss/gain and the buildup of condensation within the cavity wall grew, focus turned to thermal isolation and breaks. Another prior art development occurred in an attempt to address thermal transfer shortly after that of Reinwall/Lopez when Hatzinikolas and Pacholok of Fero Holding Ltd. introduced their sheetmetal masonry connector for a cavity wall. This device is described in U.S. Pat. Nos. 5,392,581 and 4,869,043. Here a sheetmetal plate connects to the side of a dry wall column and protrudes through the insulation into the cavity. A wire tie is threaded through a slot in the leading edge of the plate capturing an insulative plate thereunder and extending into a bed joint of the veneer. The underlying sheetmetal plate is highly thermally conductive, and the '581 patent describes lowering the thermal conductivity by foraminously structuring the plate. However, as there is no thermal break, a concomitant loss of the insulative integrity results. Further reductions in thermal transfer were accomplished through the Byna-Tie® system ('319) which provides a bail handle with pointed legs and a dual sealing arrangement as described, U.S. Pat. No. 8,037,653. While each prior art invention reduced thermal transfer, neither development provided more complete thermal protection through the use of a specialized thermally-isolating coated wall anchor, which removes thermal bridging and improves thermal insulation through the use of a thermal barrier.

Focus on the thermal characteristics of cavity wall construction is important to ensuring minimized heat transfer through the walls, both for comfort and for energy efficiency of heating and air conditioning. When the exterior is cold relative to the interior of a heated structure, heat from the interior should be prevented from passing through the outside. Similarly, when the exterior is hot relative to the interior of an air conditioned structure, heat from the exterior should be prevented from passing through to the interior. The main cause of thermal transfer is the use of anchoring systems made largely of metal, either steel, wire formatives, or metal plate components, that are thermally conductive. While providing the required high-strength within the cavity wall system, the use of steel components results in heat transfer.

Another application for anchoring systems is in the evolving technology of self-cooling buildings. Here, the cavity wall serves additionally as a plenum for delivering air from one area to another. The ability to size cavities to match air moving requirements for naturally ventilated buildings enable the architectural engineer to now consider cavity walls when designing structures in this environmentally favorable form.

Building thermal stability within a cavity wall system requires the ability to hold the internal temperature of the cavity wall within a certain interval. This ability helps to prevent the development of cold spots, which act as gathering points for condensation. Through the use of a thermally-isolating coating, the underlying steel wall anchor obtains a lower transmission (U-value) and thermal conductive value (K-value) and provides non-corrosive benefits. The present invention maintains the strength of the steel and further provides the benefits of a thermal break in the cavity.

In the past, the use of wire formatives have been limited by the mortar layer thicknesses which, in turn are dictated either by the new building specifications or by pre-existing conditions, e.g., matching during renovations or additions the existing mortar layer thickness. While arguments have been made for increasing the number of the fine-wire anchors per unit area of the facing layer, architects and architectural engineers have favored wire formative anchors of sturdier wire. On the other hand, contractors find that heavy wire anchors, with diameters approaching the mortar layer height specification, frequently result in misalignment. This led to the low-profile wall anchors of the inventors hereof as described in U.S. Pat. No. 6,279,283. However, the above-described technology did not address the adaption thereof to surface mounted devices. The combination of each individual wall anchor and tie combination linked together in a cavity wall setting creates a thermal thread throughout the structure thereby raising thermal conductivity and reducing the effectiveness of the insulation. The present invention provides a thermal break which interrupts and restricts thermal transfer.

In the course of preparing this Application, several patents, became known to the inventors hereof and are acknowledged hereby:

| Pat. No. | Inventor | Issue Date |
|---|---|---|
| 2,058,148 | Hard | October, 1936 |
| 2,966,705 | Massey | January, 1961 |
| 3,377,764 | Storch | April, 1968 |
| 4,021,990 | Schwalberg | May, 1977 |
| 4,305,239 | Geraghty | December, 1981 |
| 4,373,314 | Allan | February, 1983 |
| 4,438,611 | Bryant | March, 1984 |
| 4,473,984 | Lopez | October, 1984 |
| 4,598,518 | Hohmann | July, 1986 |
| 4,869,038 | Catani | September, 1989 |
| 4,875,319 | Hohmann | October, 1989 |
| 5,063,722 | Hohmann | November, 1991 |
| 5,392,581 | Hatzinikolas et al. | February, 1995 |
| 5,408,798 | Hohmann | April, 1995 |
| 5,456,052 | Anderson et al. | October, 1995 |

-continued

| Pat. No. | Inventor | Issue Date |
|---|---|---|
| 5,816,008 | Hohmann | October, 1998 |
| 6,125,608 | Charlson | October, 2000 |
| 6,209,281 | Rice | April, 2001 |
| 6,279,283 | Hohmann et al. | August, 2001 |
| 8,109,706 | Richards | February, 2012 |
| | Foreign Patent Documents | |
| 279,209 | CH | March, 1952 |
| 2,069,024 | GB | August, 1981 |

It is noted that with some exceptions these devices are generally descriptive of wire-to-wire anchors and wall ties and have various cooperative functional relationships with straight wire runs embedded in the inner and/or outer wythe.

U.S. Pat. No. 3,377,764—Storch—Issued Apr. 16, 1968 Discloses a bent wire, tie-type anchor for embedment in a facing exterior wythe engaging with a loop attached to a straight wire run in a backup interior wythe.

U.S. Pat. No. 4,021,990—Schwalberg—Issued May 10, 1977 Discloses a dry wall construction system for anchoring a facing veneer to wallboard/metal stud construction with a pronged sheetmetal anchor. Like Storch '764, the wall tie is embedded in the exterior wythe and is not attached to a straight wire run.

U.S. Pat. No. 4,373,314—Allan—Issued Feb. 15, 1983 Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 2, 1984 Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,869,038—Catani—Issued Sep. 26, 1989 Discloses a veneer wall anchor system having in the interior wythe a truss-type anchor, similar to Hala et al. '226, supra, but with horizontal sheetmetal extensions. The extensions are interlocked with bent wire pintle-type wall ties that are embedded within the exterior wythe.

U.S. Pat. No. 4,875,319—Hohmann—Issued Oct. 24, 1989 Discloses a seismic construction system for anchoring a facing veneer to wallboard/metal stud construction with a pronged sheetmetal anchor. The wall tie is distinguished over that of Schwalberg '990 and is clipped onto a straight wire run.

U.S. Pat. No. 5,392,581—Hatzinikolas et al.—Issued Feb. 28, 1995 Discloses a cavity-wall anchor having a conventional tie wire for mounting in the brick veneer and an L-shaped sheetmetal bracket for mounting vertically between side-by-side blocks and horizontally on atop a course of blocks. The bracket has a slit which is vertically disposed and protrudes into the cavity. The slit provides for a vertically adjustable anchor.

U.S. Pat. No. 5,408,798—Hohmann—Issued Apr. 25, 1995 Discloses a seismic construction system for a cavity wall having a masonry anchor, a wall tie, and a facing anchor. Sealed eye wires extend into the cavity and wire wall ties are threaded therethrough with the open ends thereof embedded with a Hohmann '319 (see supra) clip in the mortar layer of the brick veneer.

U.S. Pat. No. 5,456,052—Anderson et al.—Issued Oct. 10, 1995 Discloses a two-part masonry brick tie, the first part being designed to be installed in the inner wythe and then, later when the brick veneer is erected to be interconnected by the second part. Both parts are constructed from sheetmetal and are arranged on substantially the same horizontal plane.

U.S. Pat. No. 5,816,008—Hohmann—Issued Oct. 6, 1998 Discloses a brick veneer anchor primarily for use with a cavity wall with a drywall inner wythe. The device combines an L-shaped plate for mounting on the metal stud of the drywall and extending into the cavity with a T-head bent stay. After interengagement with the L-shaped plate the free end of the bent stay is embedded in the corresponding bed joint of the veneer.

U.S. Pat. No. 6,125,608—Charlson—Issued Oct. 3, 2000 Discloses a composite insulated framing system within a structural building system. The Charlson system includes an insulator adhered to the structural support through the use of adhesives, frictional forces or mechanical fasteners to disrupt thermal activity.

U.S. Pat. No. 6,209,281—Rice—Issued Apr. 3, 2001 Discloses a masonry anchor having a conventional tie wire for mounting in the brick veneer and sheetmetal bracket for mounting on the metal-stud-supported drywall. The bracket has a slit which is vertically disposed when the bracket is mounted on the metal stud and, in application, protrudes through the drywall into the cavity. The slit provides for a vertically adjustable anchor.

U.S. Pat. No. 6,279,283—Hohmann et al.—Issued Aug. 28, 2001 Discloses a low-profile wall tie primarily for use in renovation construction where in order to match existing mortar height in the facing wythe a compressed wall tie is embedded in the bed joint of the brick veneer.

U.S. Pat. No. 8,109,706—Richards—Issued Feb. 7, 2012 Discloses a composite fastener, belly nut and tie system for use in a building envelope. The composite fastener includes a fiber reinforced polymer. The fastener has a low thermal conductive value and non-corrosive properties.

None of the above provide a thermally-isolating coated anchoring system that maintains the thermal isolation of a building envelope. As will become clear in reviewing the disclosure which follows, the cavity wall structures benefit from the recent developments described herein that lead to solving the problems of thermal insulation and heat transfer within the cavity wall. The wall anchor assembly is modifiable for use on various style wall anchors allowing for interconnection with veneer ties in varied cavity wall structures. The prior art does not provide the present novel cavity wall construction system as described herein below.

SUMMARY

In general terms, the invention disclosed hereby is a high-strength thermally-isolating surface-mounted anchoring system for use in a cavity wall structure. The wall anchor is thermally-coated and interconnected with varied veneer ties. The veneer ties are wire formatives configured for insertion within the wall anchor and the bed joints of the outer wythe. The veneer ties are optionally compressed forming a low profile construct and swaged for interconnection with a reinforcement wire to form a seismic construct.

The first embodiment of the thermally-isolated wall anchor is a sheetmetal device with a bail type receptor for interconnection with a veneer tie. The wall anchor provides a sealing effect precluding the penetration of air, moisture, and water vapor into the inner wythe structure. The cavity portion and aperture receptor portion and optionally, the attachment portion, the wall anchor mounting surface, the outer surface and the pair of legs receive a thermally-isolating coating. The thermally-isolating coating is selected from a distinct grouping of materials, which are applied using a specific variety of methods, in one or more layers which are cured and cross-linked to provide high-strength adhesion. A matte finish is provided to form a high-strength interconnection. The thermally-coated wall anchors provide an in-cavity thermal break that interrupts the thermal conduction in the anchoring system threads running throughout the cavity wall structure. The thermal coating reduces the U- and K-values of the anchoring system by thermally-isolating the metal components.

The second embodiment of the thermally-isolated anchoring system includes a sheetmetal wall anchor with an L-shaped design having an attachment portion, at least one cavity portion with a receptor portion and a receiving aperture in the receptor portion. A pintle-type veneer tie is interconnected with the wall anchor. The receiving aperture and optionally, the attachment portion and the cavity portion receive a thermally-isolating coating.

It is an object of the present invention to provide new and novel anchoring systems for cavity walls, which systems are thermally isolating.

It is another object of the present invention to provide a new and novel high-strength metal wall anchor which is thermally coated with a thermally-isolating compound that reduces the U- and K-values of the anchoring system.

It is yet another object of the present invention to provide in an anchoring system having an inner wythe and an outer wythe, a high-strength wall anchor that interengages a veneer tie.

It is still yet another object of the present invention to provide an anchoring system which is constructed to maintain insulation integrity within the building envelope by providing a thermal break.

It is a feature of the present invention that the wall anchor hereof provides thermal isolation of the anchoring system.

It is another feature of the present invention that the wall anchor is utilizable with a dry wall construct that secures to a metal stud and is interconnected with a veneer tie.

It is another feature of the present invention that the thermally-coated wall anchor provides an in cavity thermal break.

It is a further feature of the present invention that the wall anchor coating is shock resistant, resilient and noncombustible.

Other objects and features of the invention will become apparent upon review of the drawings and the detailed description which follows.

BRIEF DESCRIPTION OF THE DRAWING

In the following drawing, the same parts in the various views are afforded the same reference designators.

DETAILED DESCRIPTION

Figure 1:
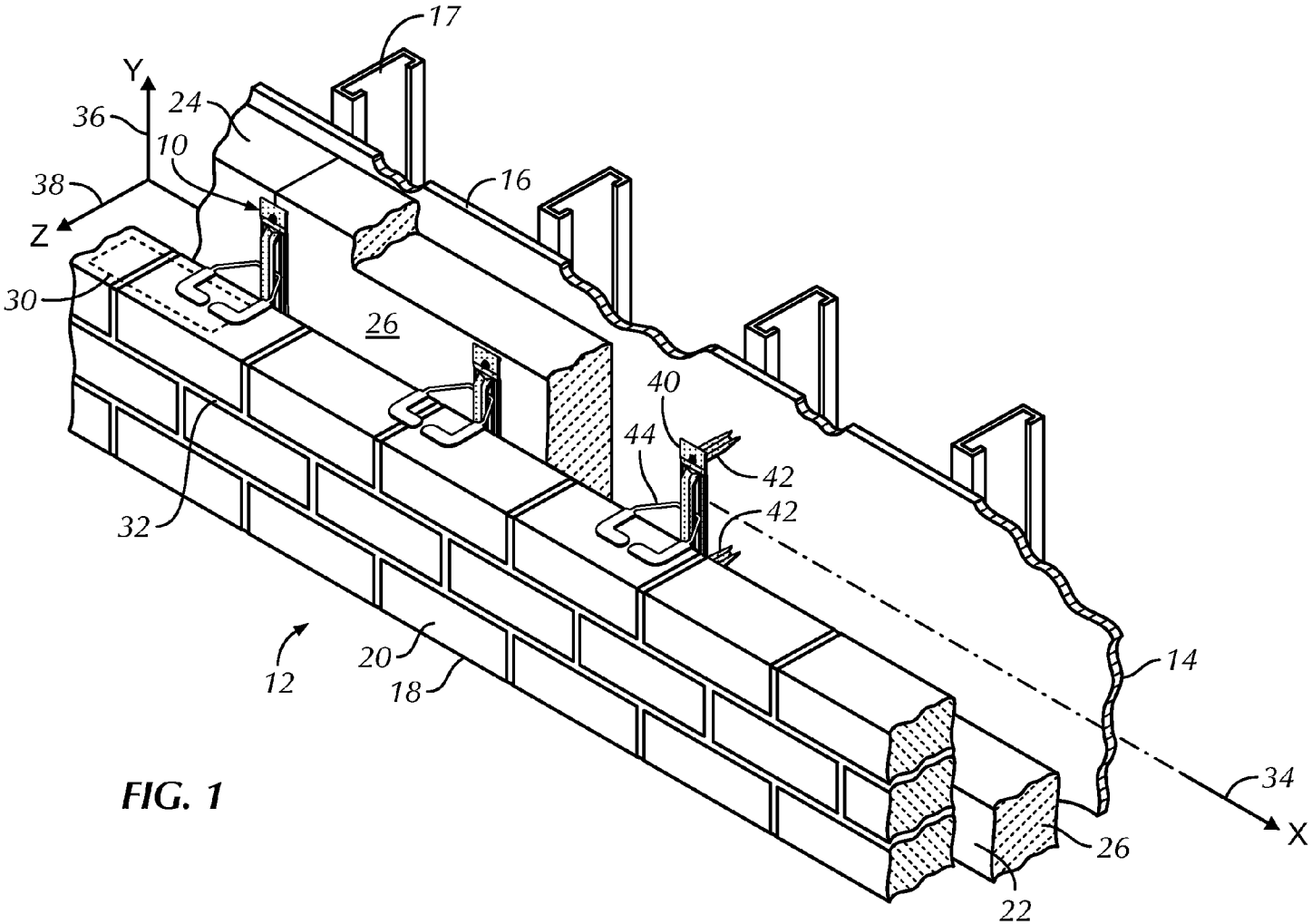
FIG. 1 shows a first embodiment of this invention and is a perspective view of a surface-mounted anchoring system with a thermally isolating wall anchor, as applied to a cavity wall with an inner wythe of dry wall construction with insulation disposed on the cavity-side thereof and an outer wythe of brick interconnected with a veneer tie.

Before entering into the Detailed Description, several terms which will be revisited later are defined. These terms are relevant to discussions of innovations introduced by the improvements of this disclosure that overcome the technical shortcoming of the prior art devices.

In the embodiments described hereinbelow, the inner wythe is optionally provided with insulation and/or a waterproofing membrane. In the cavity wall construction shown in the embodiments hereof, this takes the form of exterior insulation disposed on the outer surface of the inner wythe. Recently, building codes have required that after the anchoring system is installed and, prior to the inner wythe being closed up, that an inspection be made for insulation integrity to ensure that the insulation prevents infiltration of air and moisture. Here the term insulation integrity is used in the same sense as the building code in that, after the installation of the anchoring system, there is no change or interference with the insulative properties and concomitantly substantially no change in the air and moisture infiltration characteristics.

In a related sense, prior art sheetmetal anchors and anchoring systems have formed a conductive bridge between the wall cavity and the interior of the building. Here the terms thermal conductivity and thermal conductivity analysis are used to examine this phenomenon and the metal-to-metal contacts across the inner wythe. The present anchoring system serves to sever the conductive bridge and interrupt the thermal pathway created throughout the cavity wall by the metal components, including a reinforcement wire which provides a seismic structure. Failure to isolate the metal components of the anchoring system and break the thermal transfer, results in heating and cooling losses and in potentially damaging condensation buildup within the cavity wall structure.

In addition to that which occurs at the outer or facing wythe, attention is further drawn to the construction at the exterior surface of the inner or backup wythe. Here there are two concerns. namely, maximizing the strength of the securement of the surface-mounted wall anchor to the backup wall and, as previously discussed minimizing the interference of the anchoring system with the insulation and the waterproofing. The first concern is addressed using appropriate fasteners such as, for mounting to metal, dry-wall studs, self-tapping screws. The latter concern is addressed by the flatness of the base of the surface-mounted wall anchor and its thermally-isolating characteristics.

In the detailed description, the veneer reinforcements and the veneer ties are wire formatives. The wire used in the fabrication of veneer joint reinforcement conforms to the requirements of ASTM Standard Specification A951-00, Table 1. For the purpose of this application tensile strength tests and yield tests of veneer joint reinforcements are, where applicable, those denominated in ASTM A-951-00 Standard Specification for Masonry Joint Reinforcement.

The thermal stability within the cavity wall maintains the internal temperature of the cavity wall within a certain interval. Through the use of the presently described thermal-isolating coating, the underlying metal wall anchor, obtains a lower transmission (U-value) and thermal conductive value (K-value) providing a high strength anchor with the benefits of thermal isolation. The term K-value is used to describe the measure of heat conductivity of a particular material, i.e., the measure of the amount of heat, in BTUs per hour, that will be transmitted through one square foot of material that is one inch thick to cause a temperature change of one degree Fahrenheit from one side of the material to the other. The lower the K-value, the better the performance of the material as an insulator. The metal comprising the components of the anchoring systems generally have a K-value range of 16 to 116 W/m K. The thermal coating disposed on the wall anchor of this invention greatly reduces such K-values to a low thermal conductive (K-value) not to exceed 1 W/m K. Similar to the K-value, a low thermal transmission value (U-value) is important to the thermal integrity of the cavity wall. The term U-value is used to describe a measure of heat loss in a building component. It can also be referred to as an overall heat transfer co-efficient and measures how well parts of a building transfer heat. The higher the U-value, the worse the thermal performance of the building envelope. Low thermal transmission or U-value is defined as not to exceed 0.35 $W/m^2K$ for walls. The U-value is calculated from the reciprocal of the combined thermal resistances of the materials in the cavity wall, taking into account the effect of thermal bridges, air gaps and fixings.

Referring now to FIGS. 1 through 4, the first embodiment shows an anchoring system with a thermally isolating wall anchor that provides an in-cavity thermal break. This system is suitable for recently promulgated standards and, in addition, has lower thermal transmission and conductivity values than the prior art anchoring systems. The system discussed in detail hereinbelow, has a thermally-isolating wall anchor with a bail opening for interengagement with a veneer tie. The wall anchor is surface mounted onto an externally insulated dry wall structure with an optional waterproofing membrane (not shown) between the wallboard and the insulation. For the first embodiment, a cavity wall having an insulative layer of 2.5 inches (approx.) and a total span of 3.5 inches (approx.) is chosen as exemplary.

The surface-mounted anchoring system for cavity walls is referred to generally by the numeral 10. A cavity wall structure 12 is shown having an inner wythe or dry wall backup 14. Sheetrock or wallboard 16 is mounted on metal studs or columns 17, and an outer wythe or facing wall 18 of brick 20 construction. Between the inner wythe 14 and the outer wythe 18, a cavity 22 is formed. The wallboard 16 has attached insulation 26.

Successive bed joints 30 and 32 in the outer wythe 14 are substantially planar and horizontally disposed and in accord with building standards are a predetermined 0.375-inch (approx.) in height. Selective ones of bed joints 30 and 32, which are formed between courses of bricks 20, are constructed to receive therewithin the insertion portion 68 of the veneer tie 44 of the anchoring system hereof. Being surface mounted onto the inner wythe 14, the anchoring system 10 is constructed cooperatively therewith and is configured to minimize air and moisture penetration around the wall anchor system/inner wythe juncture.

Figure 3:
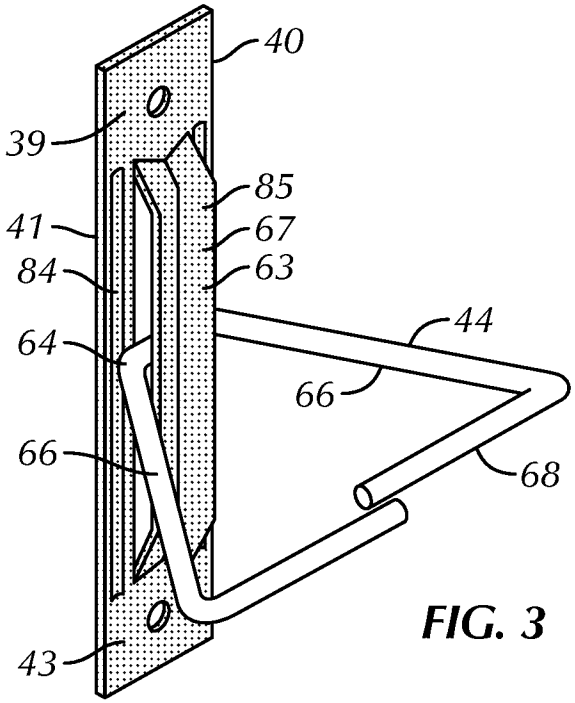
FIG. 3 is a perspective view of an alternative design thermally-isolating wall anchor and a veneer tie threaded therethrough.
Figure 2:
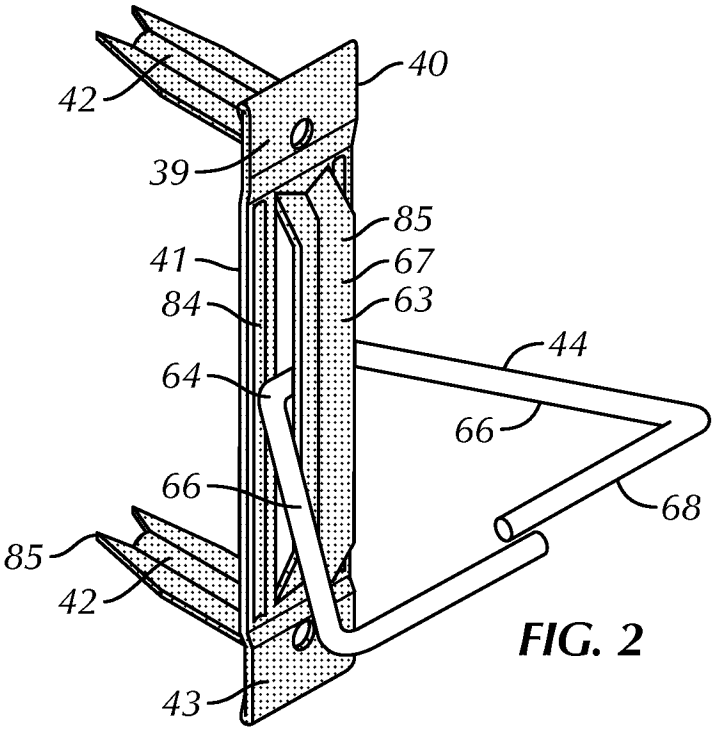
FIG. 2 is a perspective view of the surface-mounted anchoring system of FIG. 1 shown with a thermally-isolating folded wall anchor and a veneer tie threaded therethrough.
Figure 4:
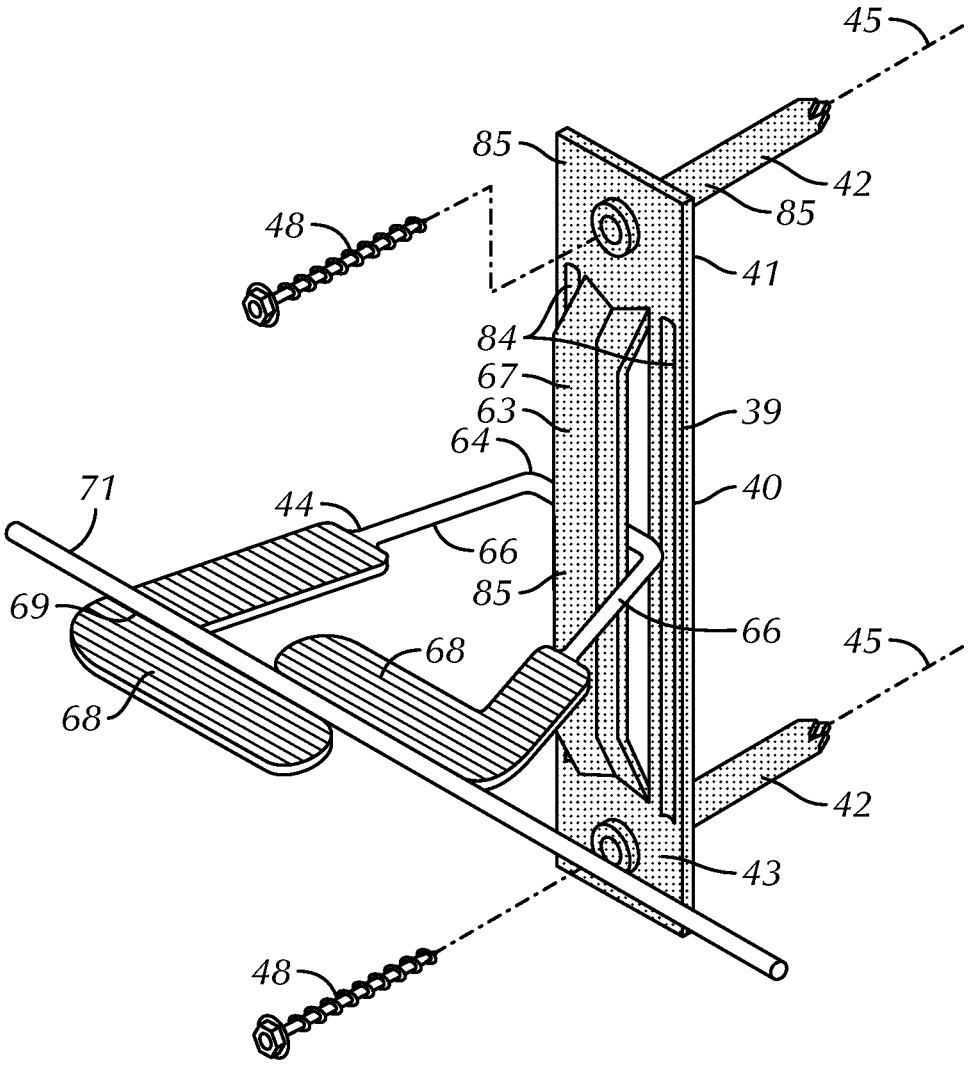
FIG. 4 is a perspective view of an alternative design thermally-isolating wall anchor with notched tubular legs and a veneer tie threaded therethrough with an interconnected reinforcement wire.

For purposes of discussion, the cavity surface 24 of the inner wythe 14 contains a horizontal line or x-axis 34 and an intersecting vertical line or y-axis 36. A horizontal line or z-axis 38, normal to the xy-plane, passes through the coordinate origin formed by the intersecting x- and y-axes. A folded wall anchor 40 as shown in FIGS. 1 and 2, is constructed from a sheetmetal plate-like body. Alternative design wall anchors 40 are shown in FIGS. 3 and 4. The wall anchor 40 has an attachment portion 39 for surface mounting on the inner wythe 14. The attachment portion 39 is comprised of a mounting face or surface 41 and an outer face or surface 43. A cavity portion 67 having a receptor or apertured receptor portion 63 is contiguous with the attachment portion 39. The wall anchor 40 is affixed (as shown in FIGS. 1, 2, and 4) with a pair of legs 42 extending from the mounting surface 41 which penetrate the inner wythe 14. The pair of legs 42 have longitudinal axes 45 that are substantially normal to the mounting surface 41 and outer surface 43. Optionally, as shown in FIG. 3, the wall anchor 40 is constructed without the pair of legs 42. The wall anchor 40 is a stamped metal construct which is constructed for surface mounting on inner wythe 14 and for interconnection with veneer tie 44 and affixed to the inner wythe 14 with a pair of fasteners 48. The receptor 63 is adjacent the outer surface 43 and dimensioned to interlock with the veneer tie 44.

The veneer tie 44 is a wire formative and shown in FIG. 1 as being emplaced on a course of bricks 20 in preparation for embedment in the mortar of bed joint 30. In this embodiment, the system includes a wall anchor 40, a veneer tie 44, and optionally a reinforcement wire 71.

At intervals along a horizontal line on the outer surface of insulation 26, the wall anchors 40 are surface mounted. In this structure, where applicable, the pair of legs 42 sheathe the pair of fasteners or mounting hardware 48. The wall anchors 40 are positioned on the outer surface of insulation 26 so that the longitudinal axis of a column 17 lies within the yz-plane formed by the longitudinal axes 45 of the pair of legs 42. Upon insertion in the inner wythe 14, the mounting surface 41 rests snugly against the opening formed thereby and serves to cover the opening, precluding the passage of air and moisture therethrough. This construct maintains the insulation integrity. In FIGS. 1, 2, and 4, the pair of legs 42 have the lower portion removed thereby forming notches which draw off moisture, condensate or water from the associated leg or hardware which serves to relieve any pressure which would drive toward wallboard 16. This construct maintains the waterproofing integrity.

Optional strengthening ribs 84 are impressed in the wall anchor 40. The ribs 84 are substantially parallel to the receptor 63 and, when mounting hardware 48 is fully seated so that the wall anchor 40 rests against the insulation 26, the ribs 84 are then pressed into the surface of the insulation 26. This provides additional sealing. While the ribs 84 are shown as protruding toward the insulation, it is within the contemplation of this invention that ribs 84 could be raised in the opposite direction. The alternative structure would be used in applications wherein the outer layer of the inner wythe is noncompressible and does not conform to the rib contour. The ribs 84 strengthen the wall anchor 40 and achieve an anchor with a tension and compression rating of 100 lbf.

A thermally-isolating coating or thermal coating 85 is applied to the receptor 63 to provide a thermal break in the cavity. The thermal coating 85 is optionally applied to the cavity portion 67, the mounting surface 41, the outer surface 43 and/or the pair of legs 42 to provide ease of coating and additional thermal protection. The thermal coating 85 is selected from thermoplastics, thermosets, natural fibers, rubbers, resins, asphalts, ethylene propylene diene monomers, and admixtures thereof and applied in layers. The thermal coating 85 optionally contains an isotropic polymer which includes, but is not limited to, acrylics, nylons, epoxies, silicones, polyesters, polyvinyl chlorides, and chlorosulfonated polyethelenes. The initial layer of the thermal coating 85 is cured to provide a precoat and the layers of the thermal coating 85 are cross-linked to provide high-strength adhesion to the veneer tie to resist chipping or wearing of the thermal coating 85.

The thermal coating 85 reduces the K-value and the U-value of the underlying metal components which include, but are not limited to, mill galvanized, hot galvanized, and stainless steel. Such components have K-values that range from 16 to 116 W/m K. The thermal coating 85 reduces the K-value of the veneer tie 44 to not exceed 1.0 W/m K and the associated U-value to not exceed 0.35 $W/m^2K$. The thermal coating 85 is not combustible and gives off no toxic smoke in the event of a fire. Additionally, the thermal coating 85 provides corrosion protection which protects against deterioration of the anchoring system 10 over time.

The thermal coating 85 is applied through any number of methods including fluidized bed production, thermal spraying, hot dip processing, heat-assisted fluid coating, or extrusion, and includes both powder and fluid coating to form a reasonably uniform coating. A coating 85 having a thickness of at least about 5 micrometers is optimally applied. The thermal coating 85 is applied in layers in a manner that provides strong adhesion to the veneer tie 44. The thermal coating 85 is cured to achieve good cross-linking of the layers. Appropriate examples of the nature of the coating and application process are set forth in U.S. Pat. Nos. 6,284,311 and 6,612,343.

The dimensional relationship between wall anchor 40 and veneer tie 44 limits the axial movement of the construct. The veneer tie 44 is a wire formative. Each veneer tie 44 has an attachment portion 64 that interlocks with the receptor 63. The receptor 63 is constructed, in accordance with the building code requirements, to be within the predetermined dimensions to limit the z-axis 38 movement and permit y-axis 36 adjustment of the veneer tie 44. The dimensional relationship of the attachment portion 64 to the receptor 63 limits the x-axis movement of the construct. Contiguous with the attachment portion 64 of the veneer tie 44 are two cavity portions 66. An insertion portion 68 is contiguous with the cavity portions 66 and opposite the attachment portion 64.

The insertion portion 68 is optionally (FIG. 4) compressively reduced in height to a combined height substantially less than the predetermined height of the bed joint 30 ensuring a secure hold in the bed joint 30 and an increase in the strength and pullout resistance of the veneer tie 44. Further to provide for a seismic construct, an optional compression or swaged indentation 69 is provided in the insertion portion 68 to interlock in a snap-fit relationship with a reinforcement wire 71 (as shown in FIG. 4).

Figure 5:
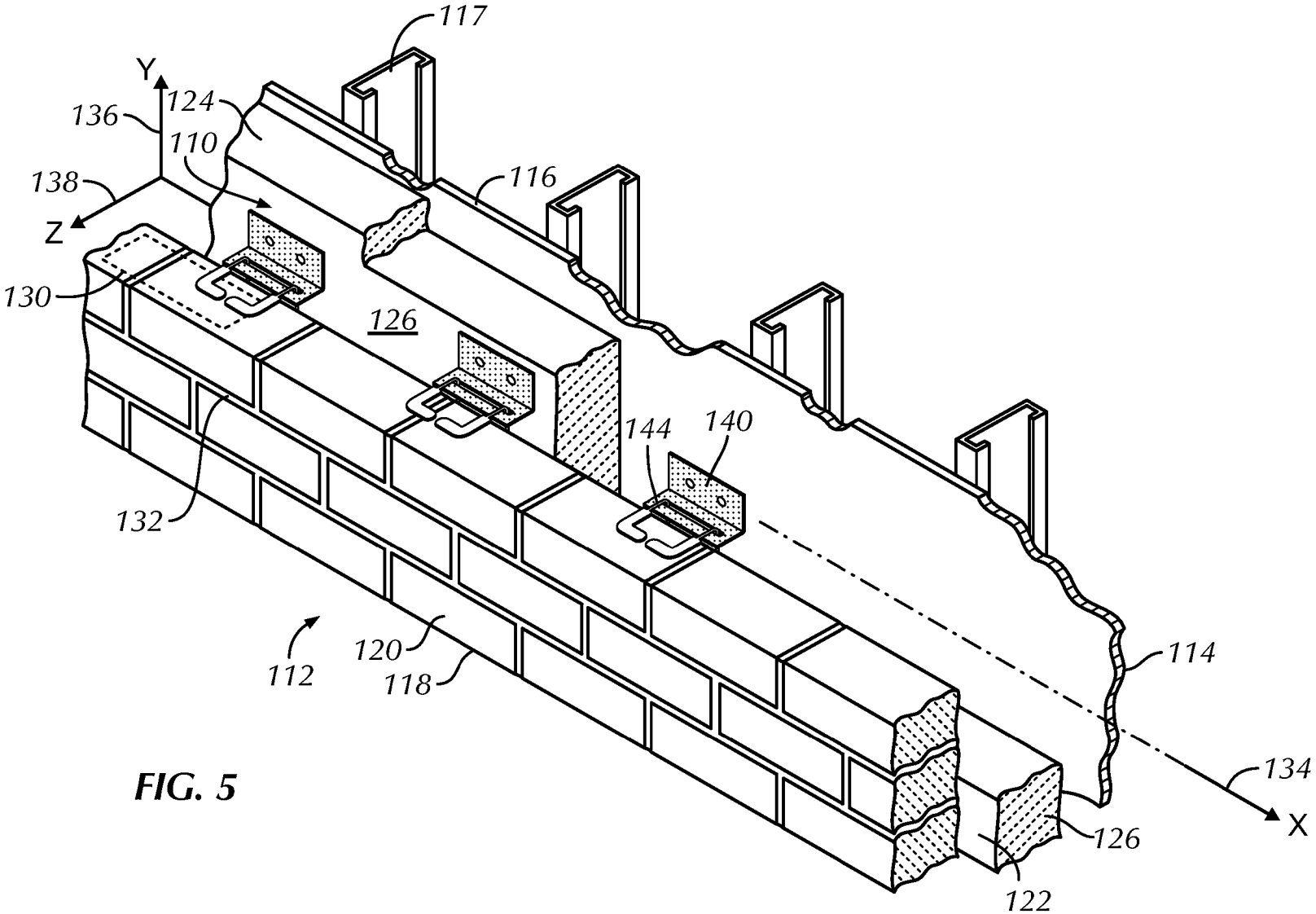
FIG. 5 is a perspective view of a second embodiment of this invention showing a surface-mounted anchoring system with a thermally isolating wall anchor, as applied to a cavity wall with an inner wythe of dry wall construction with insulation disposed on the cavity-side thereof and an outer wythe of brick interconnected with a pintle veneer tie.
Figure 6:
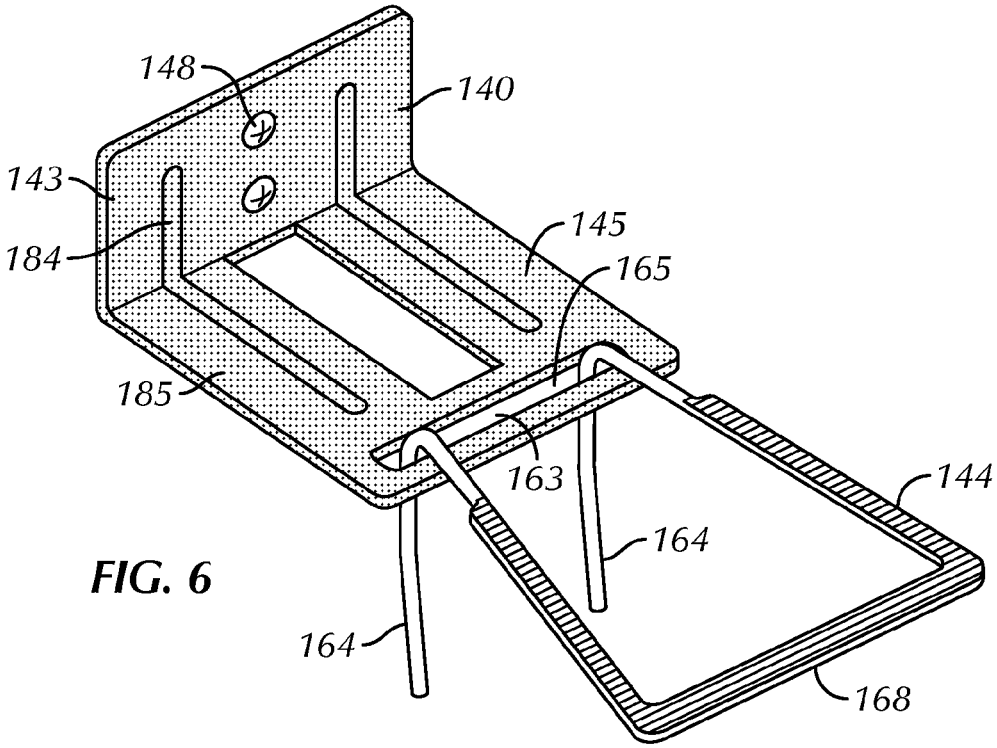
FIG. 6 is a perspective view of the anchoring system of FIG. 5 with a low profile pintle veneer tie interconnected therewith; and, FIG. 7 is a perspective view of an alternative design thermally-isolating wall anchor interconnected with a veneer tie and reinforcement wire, forming a seismic system.
Figure 7:
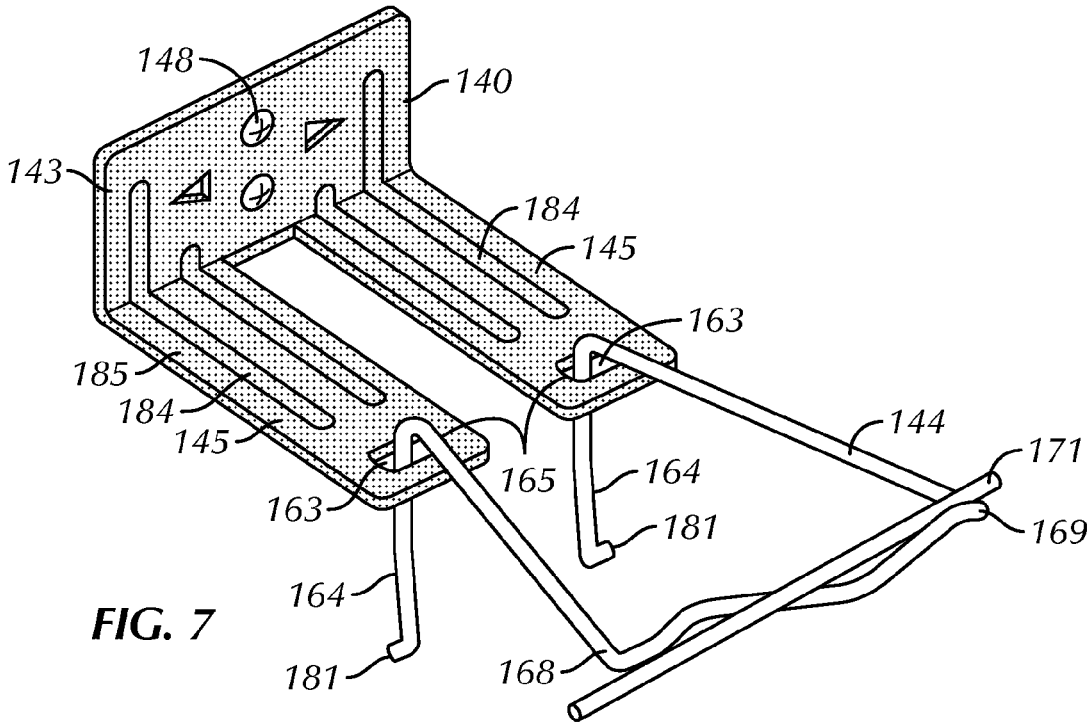

The description which follows is a second embodiment of the thermally-isolating wall anchor and anchoring system that provides an in-cavity thermal break in cavity walls. For ease of comprehension, wherever possible similar parts use reference designators 100 units higher than those above. Thus, the veneer tie 144 of the second embodiment is analogous to the veneer tie 44 of the first embodiment. Referring now to FIGS. 5 through 7, the second embodiment of the surface-mounted anchoring system is shown and is referred to generally by the numeral 110. As in the first embodiment, a wall structure 112 is shown. The second embodiment has an inner wythe or backup wall 114 of a dry wall construction with an optional waterproofing membrane (not shown) disposed thereon. Wallboard 116 is attached to columns or studs 117 and an outer wythe or veneer 118 of facing brick 120. The inner wythe 114 and the outer wythe 118 have a cavity 122 therebetween. Here, the anchoring system has a surface-mounted wall anchor 140 for interconnection with varied veneer ties 144.

The anchoring system 110 is surface mounted to the inner wythe 114. In this embodiment like the previous one, insulation 126 is disposed on the wallboard 116. Successive bed joints 130 and 132 are substantially planar and horizontally disposed and in accord with building standards set at a predetermined 0.375-inch (approx.) in height. Selective ones of bed joints 130 and 132, which are formed between courses of bricks 120, are constructed to receive therewithin the insertion portion 168 of the veneer tie 144 of the anchoring system 110 construct hereof. Being surface mounted onto the inner wythe, the anchoring system 110 is constructed cooperatively therewith.

For purposes of discussion, the insulation surface 124 of the inner wythe 114 contains a horizontal line or x-axis 134 and an intersecting vertical line or y-axis 136. A horizontal line or z-axis 138, normal to the xy-plane, passes through the coordinate origin formed by the intersecting x- and y-axes. A wall anchor 140 constructed from a metal plate-like body is shown which has an attachment portion 143 that is substantially planar in form and surface mounted on the inner wythe 114. A cavity portion 145 is contiguous with the attachment portion 143 and extends from the inner wythe 114 into the cavity 122. The cavity portion 145 contains a receptor portion 163 with a receiving aperture 165 therewithin disposed horizontally in the cavity 122 for interconnection with a veneer tie 144. A pair of fasteners 148 secures the wall anchor 140 to the inner wythe 114. In FIGS. 5 and 6, the wall anchor 140 contains a single receiving aperture 165 for interconnection with a veneer tie 144. FIG. 7 provides a variation of the wall anchor 140 having a split cavity portion 145 with two receptor portions 163 for interconnection with a veneer tie.

At intervals along the inner wythe 114, wall anchors 140 are surface mounted. The wall anchors 140 rest snugly against the inner wythe 114. Optional strengthening ribs 184 are impressed in wall anchor 140. The ribs 184 are substantially normal to the apertured receptor portion 163 and when mounting hardware 148 is fully seated, so that the wall anchor 140 rests against the insulation 126, the ribs 184 strengthen the wall anchor 140 and achieve an anchor with a tension and compression rating of 100 lbf.

The veneer tie 144 is shown in FIG. 5 as being emplaced on a course of bricks 120 in preparation for embedment in the mortar of bed joint 130. In this embodiment, the system includes a wall anchor 140 and a veneer tie 144 with an optional reinforcement wire 171 to form a seismic construct.

The dimensional relationship between wall anchor 140 and veneer tie 144 limits the axial movement of the construct. The veneer tie 144 is a wire formative. Each veneer tie 144 has an attachment portion 164 that interengages with the apertured receptor portion 163. As shown in FIGS. 5 through 7, the attachment portion 164 of the veneer tie 144 is a pintle construct. To further protect against veneer tie 144 pullout, securement portions 181 are formed from the pintle. The apertured receptor portion 163 is constructed, in accordance with the building code requirements, to be within the predetermined dimensions to limit the z-axis 138 movement and permit y-axis 136 adjustment of the veneer tie 144. The dimensional relationship of the attachment portion 164 to the apertured receptor portion 163 limits the x-axis movement of the construct and prevents disengagement from the anchoring system. Contiguous with the attachment portion 164 of the veneer tie 144 are cavity portions 166. An insertion portion 168 is contiguous with the cavity portions 166 and opposite the attachment portion 164.

The insertion portion 168 is (as shown in FIGS. 5 and 6) optionally compressively reduced in height to a combined height substantially less than the predetermined height of the bed joint 130 ensuring a secure hold in the bed joint 130 and an increase in the strength and pullout resistance of the veneer tie 144. Further to provide for a seismic construct, a compression or swaged indentation 169 is provided in the insertion portion 168 (as shown in FIG. 7) to interlock in a snap-fit relationship with a reinforcement wire 171.

A thermally-isolating coating or thermal coating 185 is applied to the receiving aperture 165 to provide a thermal break in the cavity 122. The thermal coating 185 is optionally applied to the attachment portion 143, the cavity portion 145 and the receptor portion 163 to provide ease of coating and additional thermal protection. The thermal coating 185 is selected from thermoplastics, thermosets, natural fibers, rubbers, resins, asphalts, ethylene propylene diene monomers, and admixtures thereof and applied in layers. The thermal coating 185 optionally contains an isotropic polymer which includes, but is not limited to, acrylics, nylons, epoxies, silicones, polyesters, polyvinyl chlorides, and chlorosulfonated polyethelenes. The initial layer of the thermal coating 185 is cured to provide a precoat and the layers of the thermal coating 185 are cross-linked to provide high-strength adhesion to the veneer tie to resist chipping or wearing of the thermal coating 185.

The thermal coating 185 reduces the K-value and the U-value of the underlying metal components which include, but are not limited to, mill galvanized, hot galvanized, and stainless steel. Such components have K-values that range from 16 to 116 W/m K. The thermal coating 185 reduces the K-value of the veneer tie 144 to not exceed 1.0 W/m K and the associated U-value to not exceed 0.35 $W/m^2K$. The thermal coating 185 is not combustible and gives off no toxic smoke in the event of a fire. Additionally, the thermal coating 185 provides corrosion protection which protects against deterioration of the anchoring system 110 over time.

The thermal coating 185 is applied through any number of methods including fluidized bed production, thermal spraying, hot dip processing, heat-assisted fluid coating, or extrusion, and includes both powder and fluid coating to form a reasonably uniform coating. A coating 185 having a thickness of at least about 5 micrometers is optimally applied. The thermal coating 185 is applied in layers in a manner that provides strong adhesion to the veneer tie 144. The thermal coating 185 is cured to achieve good cross-linking of the layers. Appropriate examples of the nature of the coating and application process are set forth in U.S. Pat. Nos. 6,284,311 and 6,612,343.

As shown in the description and drawings, the present invention serves to thermally isolate the components of the anchoring system reducing the thermal transmission and conductivity values of the anchoring system to low levels. The novel coating provides an insulating effect that is high-strength and provides an in cavity thermal break, severing the thermal threads created from the interlocking anchoring system components.

In the above description of the anchoring systems of this invention various configurations are described and applications thereof in corresponding anchoring systems are provided. Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A thermally-isolating sheetmetal wall anchor for use with an anchoring system in a wall having an inner wythe and an outer wythe, the inner wythe formed from a drywall backup wall mounted on metal studs or columns, the inner wythe and the outer wythe in a spaced apart relationship the one with the other forming a cavity therebetween, the wall anchor comprising:

an attachment portion substantially planar in form for surface mounting on the inner wythe;

a cavity portion contiguous with the attachment portion, the cavity portion having a receptor for interconnection with a veneer tie; and, a thermally-isolating coating disposed on the receptor, the coating having low thermal conductivity and transmissivity, the coating forming a thermal break in the cavity;

wherein upon installation within the anchoring system in the cavity wall, the wall anchor restricts thermal transfer between the veneer tie and the wall anchor and between the wall anchor and the veneer tie.

2. The wall anchor according to claim 1, wherein the thermally-isolating coating is one or more layers of a compound selected from the group consisting of thermoplastics, thermosets, natural fibers, rubbers, resins, asphalts, ethylene propylene diene monomers, and admixtures thereof.

3. The wall anchor according to claim 2, wherein the selected compound is an isotropic polymer selected from the group consisting of acrylics, nylons, epoxies, silicones, polyesters, polyvinyl chlorides, and chlorosulfonated polyethelenes.

4. The wall anchor according to claim 2, wherein the thermally-isolating coating is applied in layers including a prime coat; and wherein, upon curing, the outer layers of the thermally-isolating coating are cross-linked to the prime coat to provide high-strength adhesion to the wall anchor cavity portion.

5. The wall anchor according to claim 2, wherein the thermally-isolating coating reduces the K-value of the wall anchor to a level not to exceed 1.0 W/m K.

6. The wall anchor according to claim 2, wherein the thermally-isolating coating reduces the U-value of the wall anchor to a level not to exceed 0.35 $W/m^2K$.

7. The wall anchor according to claim 2, wherein the thermally-isolating coating is further applied to the attachment portion and the cavity portion.

8. A surface-mounted anchoring system for use in the construction of a wall having an inner wythe and an outer wythe, the inner wythe formed from a drywall backup wall mounted on metal studs or columns, the outer wythe formed from a plurality of successive courses with a bed joint, having a predetermined height, between each two adjacent courses, the inner wythe and the outer wythe in a spaced apart relationship the one with the other forming a cavity therebetween, the anchoring system comprising:

a wall anchor fixedly attached to the inner wythe constructed from a metal plate-like body, the wall anchor, in turn, comprising;

an attachment portion substantially planar in form for surface mounting on the inner wythe;

at least one cavity portion contiguous with the attachment portion, the cavity portion extending from the inner wythe and having a receptor portion, upon installation thereof, extending into the cavity and terminating therewithin;

a receiving aperture in the receptor portion, upon installation, disposed horizontally in the cavity; and, a thermally-isolating coating disposed on the receiving aperture, the coating having low thermal conductivity transmissivity, the thermally-isolating coating having one or more layers of a compound selected from the group consisting of thermoplastics, thermosets, natural fibers, rubbers, resins, asphalts, ethylene propylene diene monomers, and admixtures thereof, the coating forming a thermal break in the cavity;

a wire formative veneer tie interlockingly connected within the receiving aperture and configured for embedment in the bed joint of the outer wythe to prevent disengagement from the anchoring system; and, a pair of fasteners affixing the wall anchor to the inner wythe.

9. The anchoring system according to claim 8, wherein the thermally-isolating coating reduces the K-value of the wall anchor to a level not to exceed 1.0 W/m K and the U-value to a level not to exceed 0.35 $W/m^2K$.

10. The anchoring system according to claim 8, wherein the thermally-isolating coating is further applied to the attachment portion and the cavity portion.

11. The anchoring system according to claim 8, wherein the selected compound is an isotropic polymer selected from the group consisting of acrylics, nylons, epoxies, silicones, polyesters, polyvinyl chlorides, and chlorosulfonated polyethelenes.

12. The anchoring system according to claim 8, wherein the thermally-isolating coating is applied in layers including a prime coat; and wherein, upon curing, the outer layers of the thermally-isolating coating are cross-linked to the prime coat to provide high-strength adhesion to the wall anchor.

* * * * *